33-241 SR
12/22/87 OR 4,713,889

United States Patent [19]

Santiago

[11] Patent Number: 4,713,889

[45] Date of Patent: Dec. 22, 1987

[54] ILLUMINATED GUNSIGHT

[76] Inventor: Julio A. Santiago, 13713 Susan La., Burnsville, Minn. 55337

[21] Appl. No.: 930,864

[22] Filed: Nov. 14, 1986

[51] Int. Cl.[4] ..... F41G 1/32

[52] U.S. Cl. ..... 33/241; 335/205; 224/911; 224/246

[58] Field of Search ..... 33/241, 242, 243; 335/205; 224/911, 246

[56] References Cited

U.S. PATENT DOCUMENTS

| | | | |
|---|---|---|---|
| 3,239,658 | 3/1966 | Castaldo | 335/205 X |
| 3,678,590 | 7/1972 | Hayward | 33/241 |
| 3,914,873 | 10/1975 | Elliott et al. | 33/241 |
| 4,003,507 | 1/1977 | Elton | 224/911 X |
| 4,434,560 | 3/1984 | Comeyne | 33/241 |
| 4,533,980 | 8/1985 | Hayes | 33/241 |

*Primary Examiner*—William D. Martin, Jr.

*Attorney, Agent, or Firm*—Jacobson and Johnson

[57] ABSTRACT

This invention comprises an illuminated gunsight attachment for mounting on a weapon to permit the user to aim and shoot in low-light conditions. The illuminated gunsight includes a light-emitting diode for a front sight and an illuminated rod for a rear sight. The invention also includes a magnetic switch which automatically activates the power circuit to illuminate the sights as the revolver is withdrawn from its holster. The illuminated gunsight attachment is mounted unobtrusively on the barrel of a weapon to permit use of either conventional sight posts of the weapon or the illuminated sights of the invention. In one embodiment the rear sight is formed by a set of parallel lines comprised of flourescent markings located on opposite sides of an illuminated line. The invention also includes a firearm holster with a magnet thereon for activating the illuminated gunsight as it is withdrawn from the holster.

18 Claims, 14 Drawing Figures

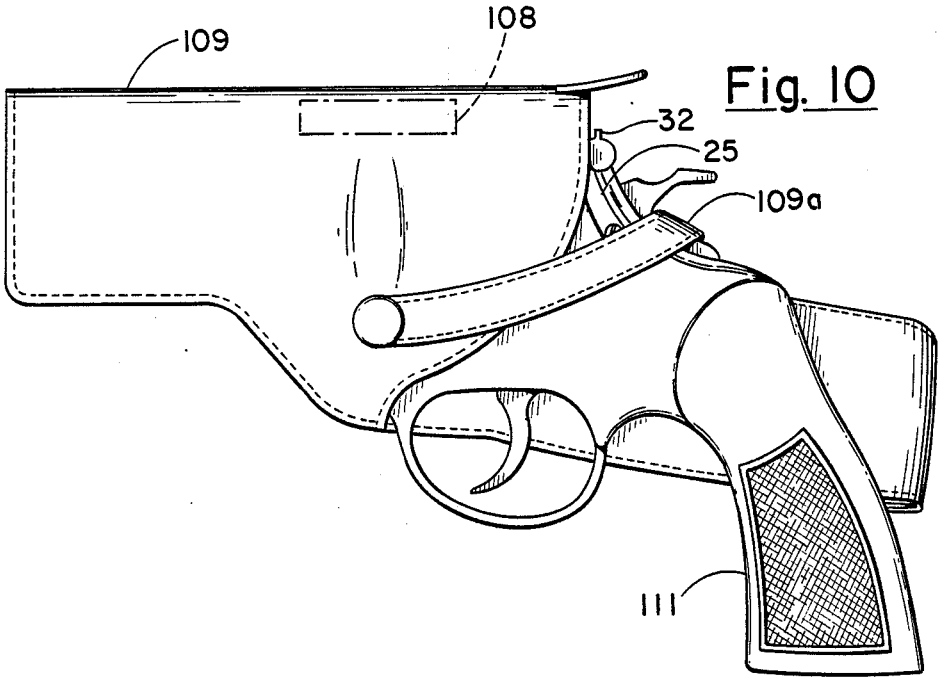
Fig. 10
Fig. 11
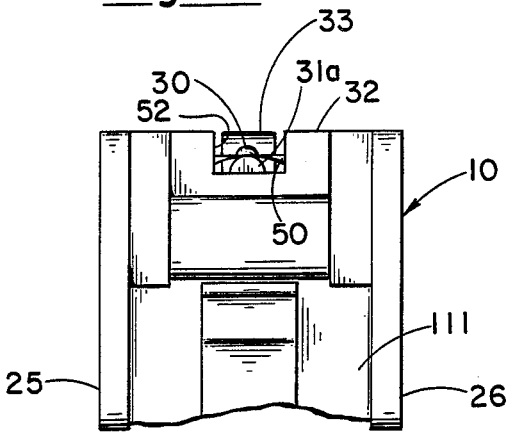
Fig. 13
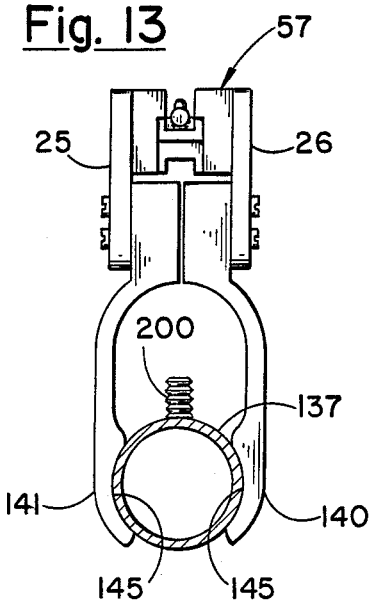

ILLUMINATED GUNSIGHT

BACKGROUND OF THE INVENTION

1. Field of the Invention

This invention relates to gunsights and, more particularly, to illuminated gunsights and gunsights for shooting during the day, at night, or under artificial lighting conditions.

2. Description of the Prior Art

The prior art to this invention includes hand-held flashlights, flashlights mountable on firearms, light-reflective material for sight posts, infrared scopes, and radioluminescent gunsights. Unfortunately for the law enforcement vocation, the prior art has failed to produce an effective and inexpensive gunsight for shooting in the dark.

A law enforcement officer routinely works in dark environments. For example, at night the cop works under sparse, artificial light sources such as headlights, street lamps, and neon signs, if such light exists at all. Even the cop who works the day shift may investigate in darkened basements and warehouses. In short, the cop's beat necessarily includes such environments because darkness is the criminal's accomplice.

Whether hand-held or mounted on a police revolver, the flashlight is a crude gunsight in law enforcement. A significant problem is that a flashlight blatantly advertises the location of the police officer and, moreover, provides a source of light for the criminal's own gunsight while the criminal himself remains enveloped in darkness. Furthermore, the flashlight is a bulky and massive instrument that is cumbersome to handle and awkwardly difficult to switch on and aim at the targeted criminal, especially when time is of the essence.

The prior art also includes sight posts illuminable by light reflective material. The light reflective gunsight may not advertise the location of the police officer as blatantly as the flashlight, needs no external power source, and adds no significant weight or bulk or change in structure to the traditional sight posts. Although gunsights having light reflective material overcome some of the problems posed by flashlights, light reflective gunsights fail when they are needed most. When no external light sources are available to illuminate the light reflective material, the light reflective gunsight is rendered as useless as a gunsight without light reflective sight posts.

The infrared light scope is prohibitively expensive and thus more suited for the military than the local police forces or the individual, who may not have the financial resources of the military. Moreover, infrared light scopes need adjacent, extensive, massive equipment which does not lend itself to the purposes of a patrol officer, who must travel light and be able to react instinctively.

My prior art illuminated sight shown in the Knutsen and Santiago U.S. Pat. No. 3,641,676 teaches a radioluminescent gunsight and method that solved many of the problems of the prior art. It included its own light source. It was adaptable to conventional sight posts. It did not advertise the location of the police officer. However, since it was mildly radioactive, the regulations requiring the handling of radioactive material made it unprofitable to market. Furthermore, even if federal regulations were lessened for low-level radioactive devices, it is conceivable that in a society that witnessed the nuclear accidents at Three Mile Island and Chernobyl, consumers would not accept radioactive gunsights.

The prior art also includes a revolver having a pair of light-emitting diodes, one for a rear sight post and one for a front sight post. One such device is manufactured by the Triple K Manufacturing Co. In the Triple K device, the light-emitting diodes, connecting electrical wires, and the remaining components of the electrical system are placed in holes and grooves which are milled into the metal body of the firearm. The electrical wires are then covered with black epoxy. A nickel-cadmium battery, a rheostat, resistors, a recharge jack, and a momentary switch are installed in the butt of the gun. The backside of the rear light-emitting diode is also covered with black epoxy to reflect light onto the conventional rear sight which is coated with white reflective epoxy. Thus the rear light-emitting diode is not used as a sight but is used to illuminate the conventional rear sight on the gun.

The incorporation of the Triple K system poses a number of problems. For example, the metal body of the firearm may be weakened by milling grooves for the electrical system. While the grooves milled in the butt of the gun may be relatively harmless, it is extremely hazardous to mill a groove lengthwise across the firearm's barrel as the milled groove provides a weakened section which may behave like a score and cause the barrel to split if the gun should mal-function.

Even though the electrical wires are secured in the milled grooves by epoxy, it is dangerous to expose the cartridge chamber firing arm and other movable parts of the firearm to potential obstructions. In the rigorous law enforcement vocation, it is easily conceivable that the firearm could be rendered inoperative at the least opportune times by loose electrical wires.

A further problem is utilizing a momentary switch of either the capacitive or mechanical type as a means to activate the light-emitting diodes. If the momentary switch is a capacitive switch, it may fail to be activated if the shooter is wearing gloves. If the momentary switch is a mechanical switch, the shooter wastes crucial seconds to ensure that he or she is correctly gripping the butt of the firearm to activate the switch. An exposed momentary mechanical switch can also be inadvertently turned on by inserting the firearm in a holster or by simply laying the firearm on its side, thereby draining the battery.

In addition, the second light-emitting diode emanates superfluous light for the purpose of shooting in low-light conditions. One disadvantage of illuminated gunsights is that they blatantly advertise the location of a police officer if the gunsight emits too much light. With two light-emitting diodes that emit light in at least two locations makes the police officer holding a gun a potential target for a criminal.

Finally, the Triple K gunsights not only emit too much light, but also emit the light in the wrong direction. The backside of the rear light-emitting diode is covered by black epoxy to reflect the light forward and onto the conventional rear sight which is coated with white epoxy to make it more visible. This forward, flashlight-like reflection unfortunately emits light forwardly and may flash like a revolving beacon on a moonless night as the officer points his firearm in a darkened environment.

SUMMARY OF THE INVENTION

This invention comprises an illuminated gunsight for shooting in the dark that provides its own light source, conforms to conventional sight posts and sighting methods, switches on automatically as the firearm is drawn from its holster, is relatively inexpensive, and is invisible to the targeted criminal. The illuminated gunsight has a light-emitting diode for a front sight and an illuminated translucent rod for a rear sight. The rod is illuminated by the light-emitting diode and provides a linear line of light of a different intensity than the light-emitting diode so that the light-emitting diode and the linear line of light may be readily aligned. A second preferred embodiment includes an illuminated dot, instead of a linear line of light, for the rear sight. A third preferred embodiment uses a luminescent line as a rear sight.

The light-emitting diode is provided with its own power source and switching means, which are located on top of a barrel of a firearm without obstructing vision or hindering other firing procedures. The switching means for the power source includes a magnetic switch which is sensitive to a permanent magnet lodged in a holster. Upon withdrawing the firearm from the holster the magnetic switch is activated, thereby turning on the light-emitting diode and providing a readily illuminable gunsight from the moment the firearm is withdrawn from the holster. Moreover, the illuminated gunsight is incorporated into the existing structure of the traditional gunsight. The adaptation of the illuminated gunsight to conventional sight posts allows the police officer to use conventional sighting and aligning methods when adequate lighting exists and to use the illuminated sights when darkness pervades his working environment. Furthermore, by interlineating the illuminated gunsight between the conventional front and rear sight posts, the light from the illuminated gunsight is invisible to the targeted criminal.

BRIEF DESCRIPTION OF THE DRAWINGS

FIG. 10 shows a side plan view of a revolver strapped in a holster having a magnet lodged therein;

FIG. 11 shows a back plan view of my invention mounted on a revolver having conventional gunsights;

FIG. 13 shows a partially cut-away, back plan view of my invention mounted on a barrel of a rifle.

DESCRIPTION OF THE PREFERRED EMBODIMENTS

Figure 1:
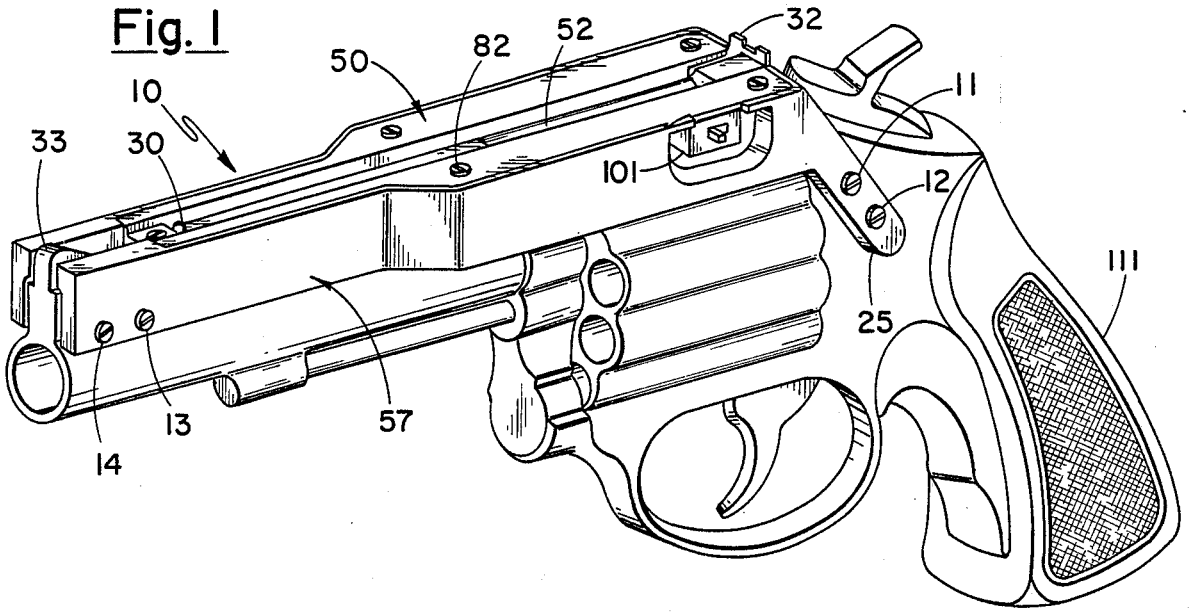
FIG. 1 is a side perspective view of my invention mounted on a barrel of a revolver.

FIG. 1 is a side perspective view of a gunsight 10 mounted on the top of the barrel of a .38 caliber Smith and Wesson police revolver. The gunsight is secured to the gun by a plurality of screws 11–14 and 21–24 (not shown). Screws 11–12 and 21–22 (not shown) secure a left support arm 25 and a right support arm 26 (not shown) to the revolver. A light-emitting diode (LED) or sight post 30 is mounted near the front top side of the gunsight to form a front illuminated sight. An acrylic rod 31 (FIG. 5) is mounted near the top of the gunsight and between the light-emitting diode 30 and the conventional rear sight post 32. In the embodiment shown in FIG. 1 the end 31*a* (see FIG. 5) of acrylic rod 31 forms the rear illuminated sight. A mechanical switch 40 for the light-emitting diode 30 is located near the rear, left side of the gunsight. The light-emitting diode 30 and acrylic rod 31 are fixed in gunsight 10. Alignment of sights 30 and 31*a* with individual revolvers having their own particular bullet trajectories is accomplished by adjusting the screws 11–14 and 21–24. Vertical and lateral adjustment of the gunsight 10 is provided by locating screws 11–14 and 21–24 on opposite sides.

The gunsight 10 is mounted unobtrusively on the barrel of the revolver. The orientation of the gunsight 10 allows the handler of the revolver to load, unload, aim, shoot, disassemble, clean, holster, draw and otherwise utilize the revolver in normal fashion. Furthermore, even with the gunsight 10 and the night sight 30–31*a* mounted on the barrel of the revolver, the day sight posts 32–33 may be aligned and juxtaposed in normal fashion without visual hindrance from the night sights 30 and 31*a*.

Figure 2:
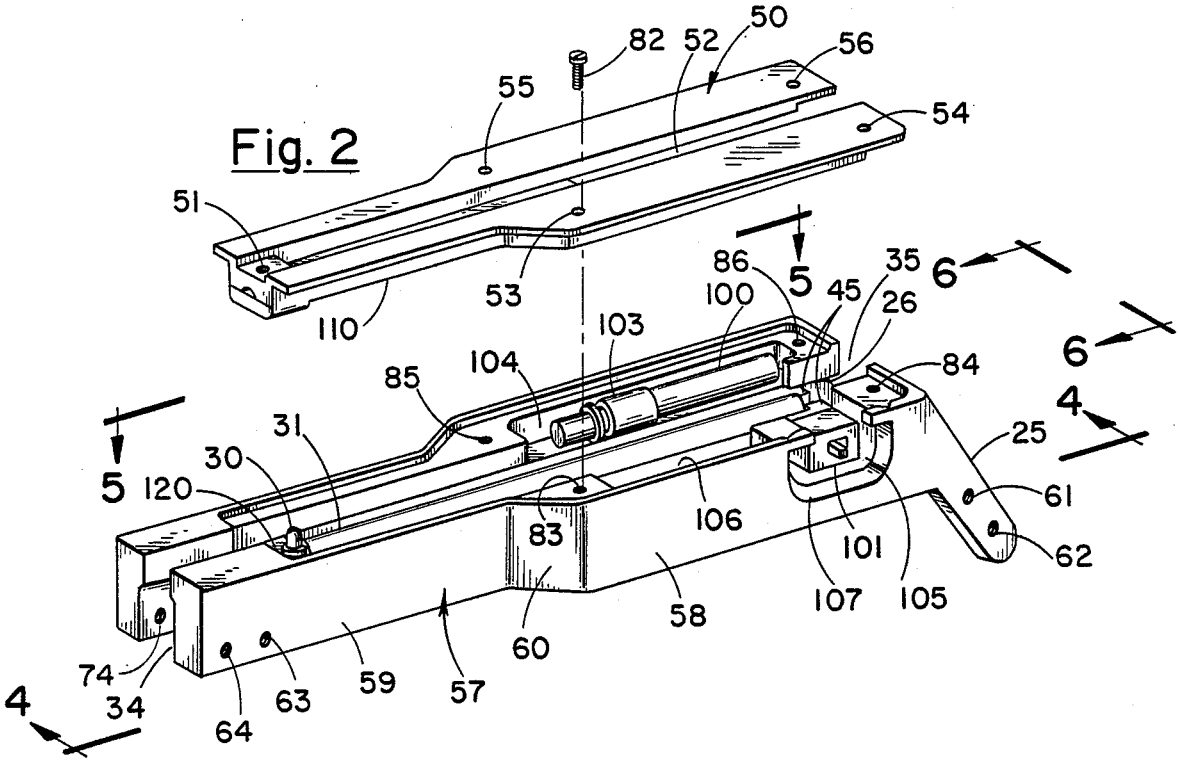
FIG. 2 is a broken-apart perspective view of my invention.

FIG. 2 shows a broken-apart view of my gunsight. A top cover 50 of the gunsight 10 has a hole 51 located near the front of the gunsight for the light-emitting diode 30 to pass therethrough so that the light emanating from the diode 30 may be observed with the cover 50 in place. An elongated U-shaped channel 52 is formed in the top portion of cover 50 to act as a sighting channel. In the embodiment of FIG. 1 the acrylic rod 31, with the exception of end 31, remains concealed by the cover 50 to preclude the illuminated acrylic rod 31 from being visible to either the shooter or to others. The parallel, elongated U-shaped channel 52 is located in a linear fashion between the hole 51 and the rear of the cover 50 and runs parallel to the barrel of the revolver. Holes 53–56 allow the cover 50 to be fastened to a casing 57 of the gunsight 10 with screws and are aligned with holes 83–86 in the housing or casing 57. It should also be noted that the cover 50 has a shoulder 110 that runs about the circumference of the cover 50 and is mateable to the casing 57.

The casing 57 has a left rear portion or side 58 and a left front portion or side 59. A tapered portion or side 60 integrally connects the rear portion 58 to the front portion 59. Similarly, casing 57 has a right rear side 68, a right front side 69, and a right tapered side 70 that integrally attaches side 68 to side 69. Sides 58–60 are integrally connected to sides 68–70 by a center support or acrylic rod platform 45. Sides 58 and 68 are parallel and spaced apart so that a battery 100, a mechanical switch 101, a magnetic switch 102 (not shown), and the acrylic rod 31 may be located within the casing 57. The battery 100 is placed in a battery socket 103 and lies parallel to side 68 and within a battery cavity 104. A mechanical switch cavity 105 for the mechanical switch 101 is formed in the left rear section 58 of gunsight 10. A mechanical switch inlet 107 is formed in the left rear side 58 of casing 57 so that the mechanical switch 101, while remaining accessible to the handler of the revolver, lies in a recess and would not be accidentally turned off when, for instance, the revolver is withdrawn from its holster. The magnetic switch 102 lies in a magnetic switch cavity 106, which is formed in the left rear side 58. A space 34 is formed between sides 59 and 69 for the mechanical front sight post 33 and a space 35 is formed between sides 58 and 68 for the mechanical rear sight post 32. The casing 57 has screw holes 61–64 and 71–74 (71–73 not shown) for screws 11–24 for mounting the gunsight 10 on a revolver.

Figure 3:
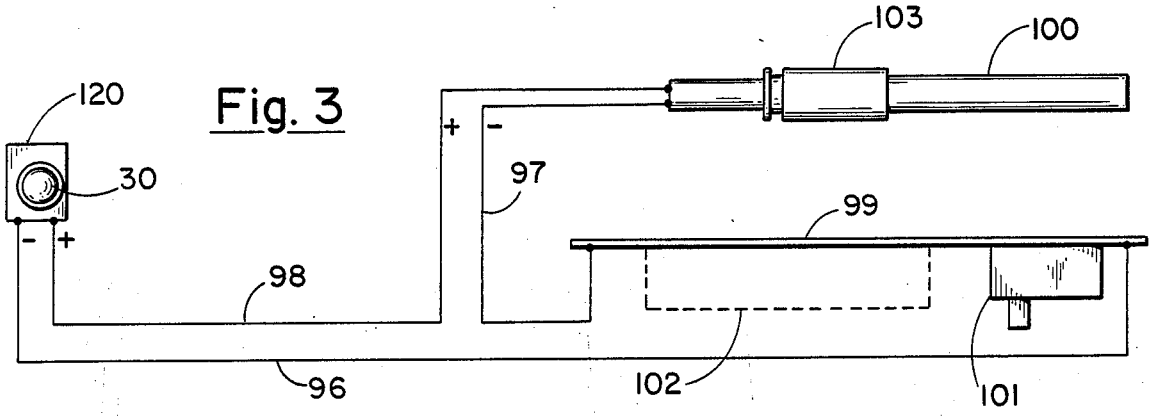
FIG. 3 shows a wiring schematic of my invention.

FIG. 3 shows a wiring schematic of my invention. The schematic includes the light-emitting diode 30, the magnetic switch 102, the mechanical switch 101, and the battery 100. The magnetic switch 102 and the mechanical switch 101 lie in series. Usually, the mechanical switch 101 would be maintained in an on position and the police officer would rely on the magnetic switch 102 to turn the light-emitting diode 30 on and off. In operation, the magnetic switch 102 will be activated when the pistol is drawn from its holster. (See also FIG. 10.) When the pistol is holstered, a magnet 108 oriented in the holster in an appropriate location will provide a magnetic field to thereby open the magnetic switch 102 and turn off the light-emitting diode once the revolver is holstered. The incorporation of an automatic or magnetic switch 102 provides the handler or police officer with an illuminated gunsight from the moment the revolver is withdrawn from its holster. Hence, besides being economical by efficiently utilizing the battery, the magnetic switch saves time that would be wasted if the police officer would be forced to manually turn on the illuminated gunsight after withdrawing the pistol from the holster. Thus, the police officer will usually maintain the mechanical switch 101 in a closed position and merely utilize the mechanical switch 101 as an override to the magnetic switch 102. The gunsight 10 may also include a rheostat (not shown) to vary the intensity of the light emanating from the light-emitting diode.

Figure 4:
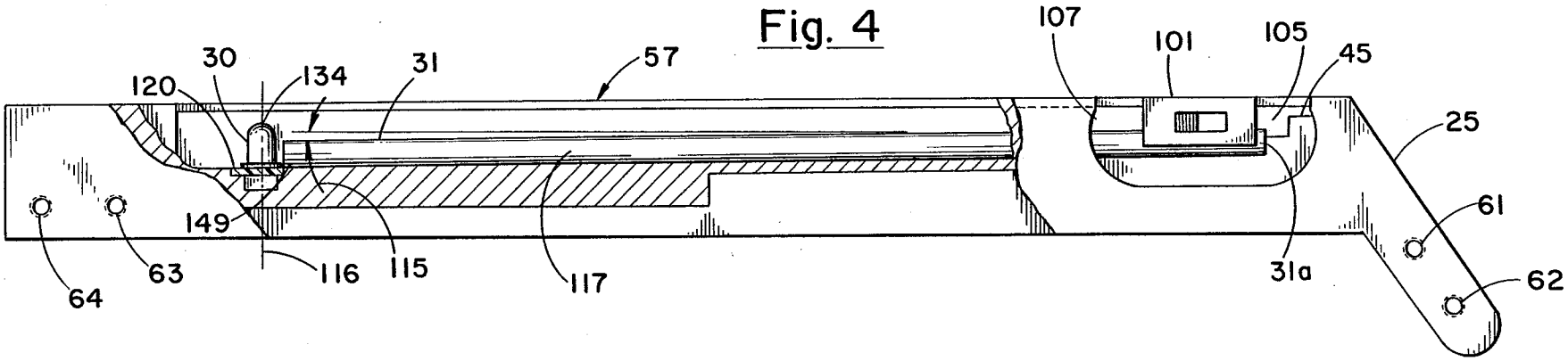
FIG. 4 is a partially cut-away, side view of my invention.

FIG. 4 is a side cut-away view of my invention without cover 50. The light-emitting diode 30 has a vertical axis 116 and the acrylic rod 31 has a horizontal axis 117. The axis 117 of the acrylic rod 31 lies in an acute angular, nonperpendicular relationship with the axis 116 of the light-emitting diode. The acrylic rod 31 typically angles upward from the bottom portion of the light-emitting diode 30 to the rear of the gunsight. As shown by angle 115 that is formed by the top of acrylic rod 31 and by a parallel line A which is parallel to the horizontal axis of the barrel of the revolver (not shown), perpendicular to the vertical axis 116 of the light-emitting diode 30 and tangential to the top edge of rear end 31*a*, the aiming or rear end 31*a* of the rod 31 is located slightly higher than the front end 149. This special, acute angular relationship as described allows the light-emitting diode 30 to perform a dual function. First, the parabolic top portion 134 of the light-emitting diode 30 acts as a front sight by collecting and focusing light from the light-emitting diode 30 so that a light source is visible from the top of the light-emitting diode 30. Second, the light-emitting diode 30 is the source of light which is transmitted through the acrylic rod 31 and subsequently emanates in the form of an illuminated circular dot (see FIG. 9*a*) or an illuminated line (see FIG. 9*b*) for a rear sight.

Figure 5:
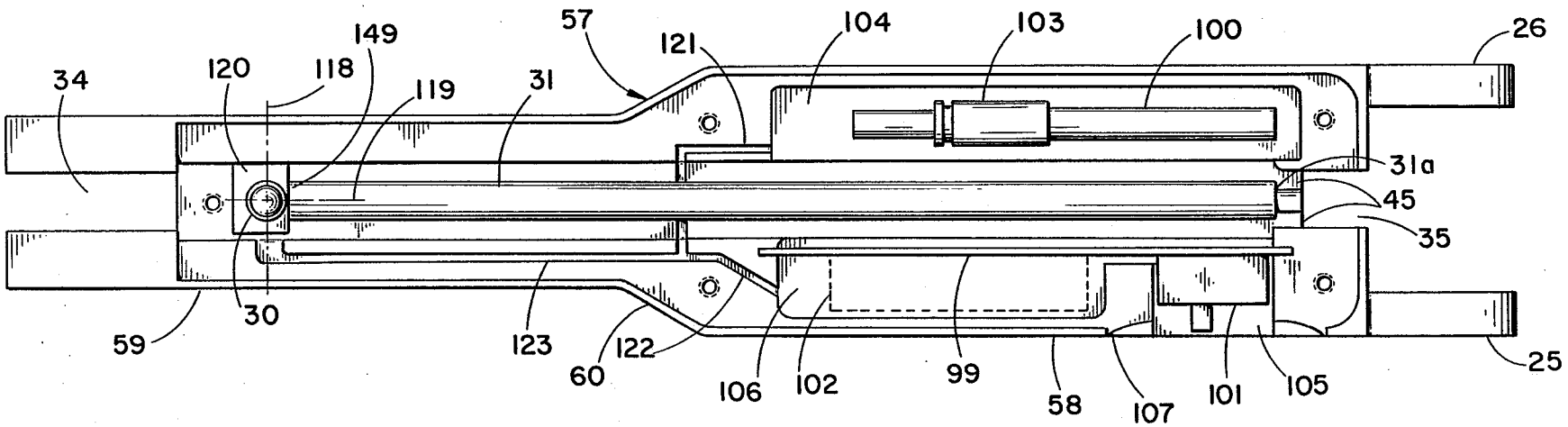
FIG. 5 is a top plan view of my invention with the cover of the invention removed.

FIG. 5 shows a top plan view of my invention with the cover 50 removed. In this figure, the light-emitting diode 30 has a second vertical axis 118 and the acrylic rod 31 has a vertical axis 119. The acrylic rod 31 lies perpendicular to the vertical axis 118 of the light-emitting diode 30 and parallel to the barrel of the revolver to provide an accurate sight line. While the light-emitting diode 30 and the acrylic rod 31 are permanently set in the casing 57 of gunsight 10, the casing 57 is vertically and laterally adjustable with respect to the barrel of the revolver to align the gunsight 10 with the trajectory path of a given revolver.

FIG. 5 also shows the printed circuitry of the gunsight 10. A positive lead 121 is imprinted on the top of casing 57. The positive lead 121 is connected to the magnetic switch 102, which is connected in series with the mechanical switch 101 (not shown). Similarly, a lead 122 is imprinted on the top side of casing 57 and connects the switches 101–102 to the light-emitting diode 30. A further lead 123 is imprinted on the top sides of casing 57 and is connected to the negative post of the battery 100. Thus, light 30, battery 100, magnetic switch 102 and mechanical switch 101 are connected in series.

Figure 6:
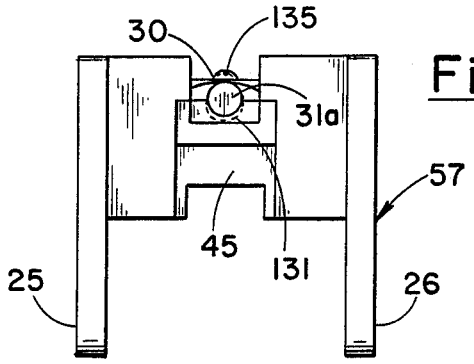
FIG. 6 shows a back plan view of my invention.

FIG. 6 shows a back plan view of my invention with cover 50 extending over rod 31. The left support arm 25 of casing 57 extends downward and below the left front side 59. Likewise, the right support arm 26 extends downward of and below of the right front side 69. An acrylic rod platform 45 is integrally attached to the left rear side 58 and the right rear side 68. An acrylic rod cavity 131 is formed on the top face of the acrylic rod platform 45 for the acrylic rod 30.

FIG. 6 also shows the linear relationship between the light-emitting diode 30 and the acrylic rod 31 that provides an accurate sight line. The light reflected by top portion 134 forms a point-like source 135 for use as a front sight. To correctly aim the revolver, the light 135 reflected by the parabolic top portion 134 of the light-emitting diode 30 is juxtaposed or aligned with the top of the illuminated aiming or rear sight 31*a* formed by the end face of acrylic rod 31. If the light 135 is aligned with the top of the illuminated end 31*a* and the light source 135 is juxtaposed or aligned directly beneath the desired target, the gun is correctly aimed. It should also be noted that the light 135 forming the front sight is of a different intensity than the light emanating from rear sight 31*a*. The different intensities allow the shooter to readily align the illuminated front sight 135 and the illuminated rear sight 31*a*. The different intensity of the light emanating from the end acrylic rod 31 is obtained by abrasing the end surface 31*a* of rod 31.

Figure 7:
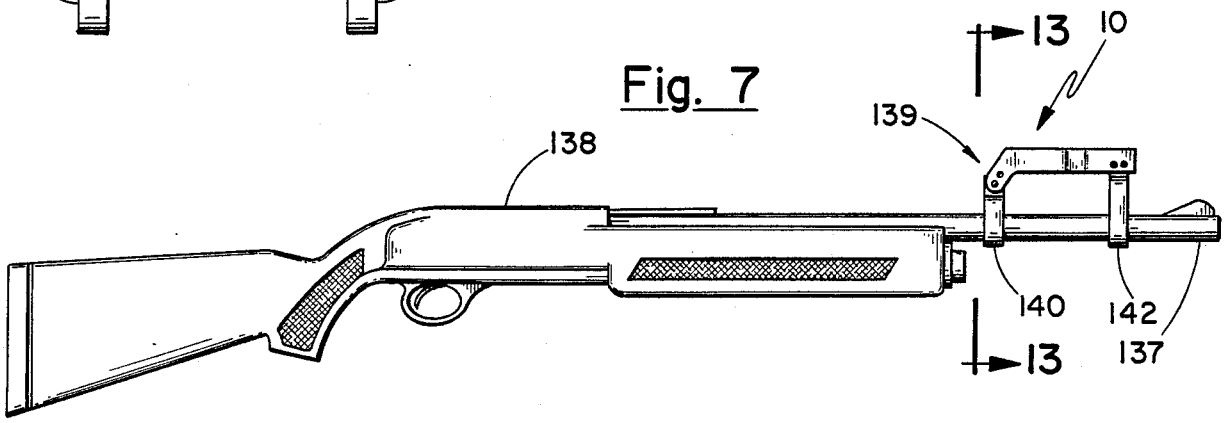
FIG. 7 shows a side plan view of my invention mounted on a barrel of a rifle.
Figure 8:
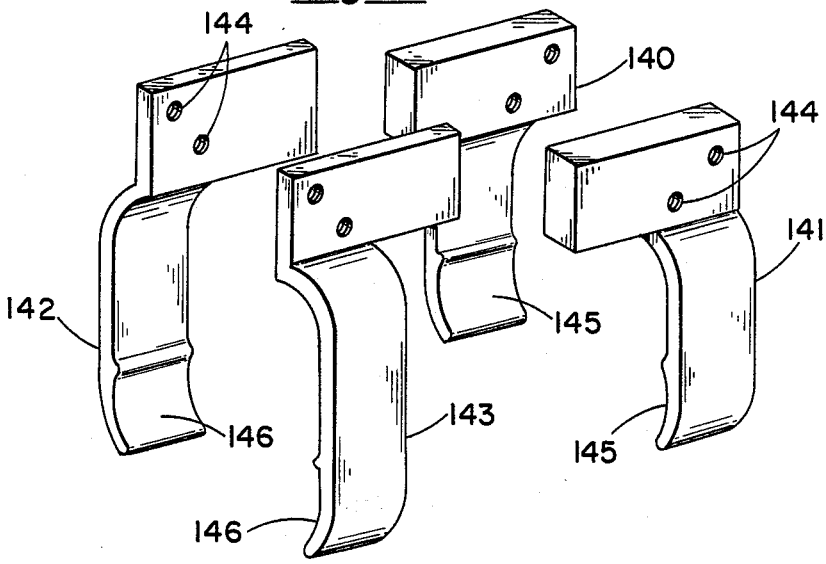
FIG. 8 shows a side perspective view of gunsight mounting brackets.

FIG. 7 and FIG. 8 show a rifle mount 139 for my illuminated gunsight which comprises a plurality of brackets to hold and mount the gunsight on the barrel of the rifle. (Also see FIG. 13.) The brackets include a right back bracket 140, a left back bracket 141, a right front bracket 142, and a left front bracket 143. The top portions of the brackets 140–143 include a plurality of mounting perforations 144 to which the gunsight is mounted. The lower portions of the brackets 140–143 include contoured gripping portions 145–146 to grip the barrel of the rifle. Brackets 140–143 are sufficiently flexible to allow one to readily attach and remove the brackets to the barrel, but are sufficiently rigid to frictionally grip the barrel of the rifle.

Figure 9A:
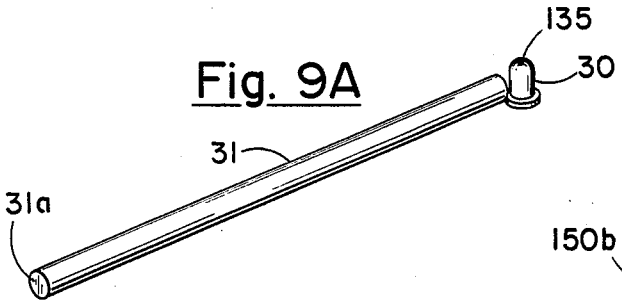
FIG. 9*a* is an isolated side perspective view of a first preferred embodiment for my illuminated sight posts.
Figure 9B:
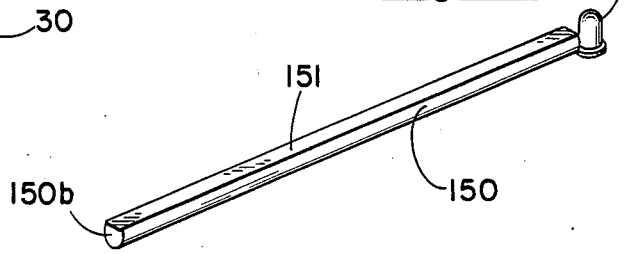
FIG. 9*b* is an isolated side perspective view of a second preferred embodiment for my illuminated sight posts.

FIGS. 9*a* and 9*b* show schematic illustrations of different preferred embodiments of my invention. FIG. 9*a* shows an acrylic cylindrical rod and a light-emitting diode adjacent the end of the acrylic rod. A vertical cross-section of the cylindrical acrylic rod produces an illuminated circle 31*a*. For aiming purposes, the user would align the light source 135 with the illuminated circular end 150 of the rod. (See FIG. 6.)

In FIG. 9*b* the alternate preferred embodiment of light-emitting diode is shown adjacent to the end of acrylic rod 150 having a top planar section 151. The planar section 151 as shown in this figure is greatly exaggerated. Typically, the planar section 151 would have a width of approximately 1/40,000 of an inch. The planar section 151 is slightly buffed, abrased, or scuffed so that as the light from the light-emitting diode travels through the acrylic rod, a portion of the light is emitted as a light line 151 instead of an illuminated circular end 31*a* as shown in FIG. 9*a*. The light line 151 extends from one end of the acrylic rod to the opposite end 150*b*. It should further be noted that, once fixed in casing 57, light line 151 lies parallel to a pair of fluorescent sight lines 36 imprinted on the cover 50. The sight lines 36 provide the user with alternative sights to conventional sights 32–33. The alternative day sight lines 36 thus allow the user to become accustomed under adequate lighting conditions to using elongated sight lines as sights.

One of the features of my invention is the use of elongated sight lines as the rear sights in combination with an illuminated front sight. The use of elongated sight lines, either fluorescent (for daytime use) or illuminated (for low-light usage) greatly aids in rapid aiming of the revolver. That is, I have found that in daytime use my U-shaped channel 52 (FIG. 1) and my fluorescent lines 36 act as a quick reference to enable a user to quickly aim the gun. Similarly, in low-light conditions, the illuminated sight line 151 enables the user to quickly align the gun. To obtain a more precise aim, the user continues to aim the weapon until the light lines become foreshortened and appear as light dots.

Figure 12:
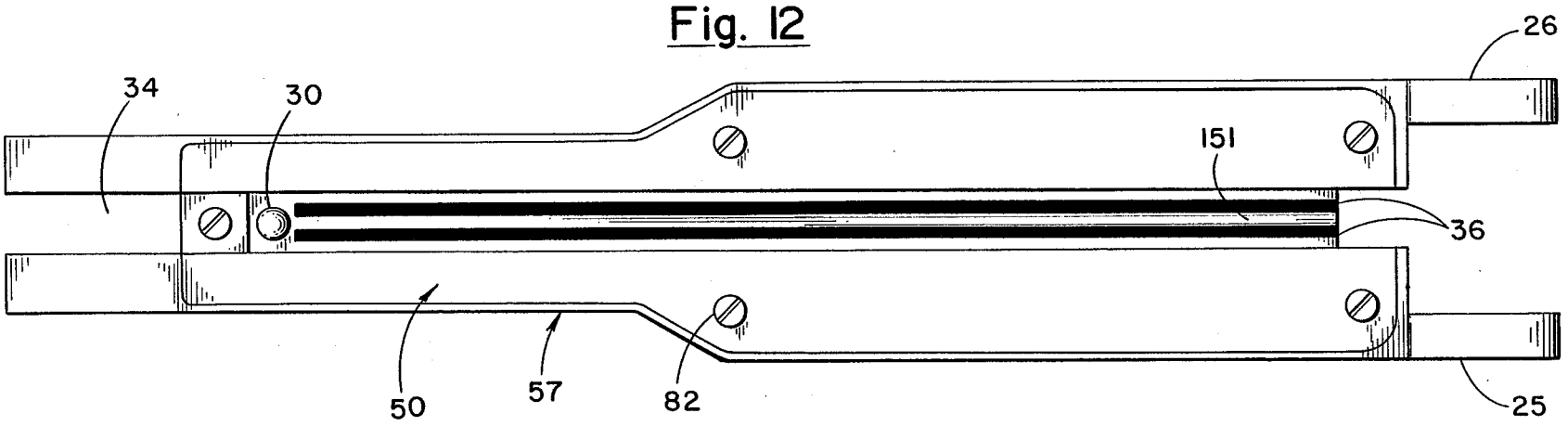
FIG. 12 is a top plan view of my invention and shows flourescent sight lines imprinted thereon.

FIG. 12 shows a top plan view of my gunsight 10 with the cover 50 having fluorescent orange sight lines 36 imprinted thereon. The fluorescent sight lines 36 run parallel to and on either side of the acrylic rod 31. During daylight hours or under adequate artificial lighting conditions, the flourescent lines 36 are readily visible to the handler of the gun and are similar in function to the elongated sight line formed on top of illuminated rod 31. The purpose of the flourescent orange sight lines 26 is to allow the shooter to become accustomed during daylight hours to aligning the illuminated sights 30–31*a*. The police officer may also use the flourescent lines 36 as sights rather than the conventional sight posts 32–33.

FIG. 11 shows a back plan view of the gunsight 10 mounted on a revolver having conventional sight posts. The illuminated sights 30–31*a* are interlineated between the conventional sight posts 32–33 to allow use of conventional sighting methods during daylight hours or when adequate lighting conditions exist. While a conventional rear sight 32 is shown, it is also possible to remove conventional rear sight 32 and use the outline of my U-shaped channel 52 as a conventional rear sight. Furthermore, the interlineation of the sights 30–31*a* with the posts 32–33 conceals the light emanated by the illuminated sights 30–31*a* from the targeted criminal. The casing 57 and cover 50 also conceal the emanating light from the targeted criminal.

FIG. 13 shows a partially cut-away back plan view of my rifle mount 139 mounted on the barrel 146 of a rifle. The brackets 140–143 are sufficiently spaced above the barrel 146 to allow the shooter to utilize either the conventional sight posts of the rifle, including the front conventional sight post 200, or the illuminated sights of the present invention.

While my illuminated gunsight has been described for use in low-light conditions, i.e., those conditions in which the outline of the target can be seen, under certain circumstances my illuminated gunsight is useful in total darkness. For example, when one is being fired on in the darkness, the flash at the end of the gun barrel can form a target. Thus, the bursts of illuminating flashes can be sighted in with my illuminated gunsights.

FIG. 10 illustrates the holster 109 of my invention which contains a magnet 108 with revolver 111 located therein. A strap 109*a* holds revolver 111 in its case when revolver 111 is not in use. Thus, one feature of my invention is a holster with a magnet 108 therein to automatically activate the illuminated gunsights.

While an acrylic rod has been used as a means for conventional light from the front sight to the rear sight, it is within the scope of my invention to use other light-conducting members as the means for conducting light.

I claim:

1. An illuminated sighting device for external attachment to a weapon to enable a user to aim and shoot a weapon in daytime or low-light conditions comprising:

a housing for external attachment to a weapon, said housing having a front end and a rear end, said housing including a sighting channel extending along said housing, said sighting channel having a bottom section;

a light-emitting diode located in the bottom of said sighting channel to form a first illuminated sight of a first intensity, said light-emitting source attached to one end of said housing;

a light-conducting rod having a first end and a second end, said first end of said light-conducting rod located adjacent said light-emitting diode to transmit illumination from said light emitting diode to said second end of said light-conducting rod to form a second illuminated sight, said second illuminated sight located in the bottom of said sighting channel and attached to said housing, said second illuminated sight of a second intensity, said second intensity different from said first intensity, said second illuminated sight and said first illuminated sight spaced from each other to enable a user to aim a weapon attached to said housing during low-light conditions; and means in said housing to permit alignment of said sighting device with respect to a weapon attached thereto.

2. The invention of claim 1 further comprising:

means for powering said light-emitting source; and switching means connected to said means for powering said light emanating source to switch on and off said light-emitting source.

3. The invention of claim 2 wherein said switching means includes:

a magnetic switch connected to said power means, said magnetic switch having a normally closed position to thereby supply power to said light-emitting source.

4. The invention of claim 3 further comprising a holster having a magnet attached thereto, said magnet oriented to activate said switching means to open said magnetic switch to turn off the power to said light-emitting source when a weapon with said illuminated sighting device is located in said holster.

5. The invention of claim 1 wherein said second illuminated sight comprises an illuminated region extending along said housing.

6. The invention of claim 1 wherein said second sight comprises a light-conducting member having a first end and a second end forming a second illuminated sight for directing light toward the user, with said second illuminated sight projecting upward from said first sight.

7. The invention of claim 1 wherein said light-conducting member comprises an acrylic rod having an illuminated end, said illuminated end forming a second sight.

8. The invention of claim 5 wherein said illuminated region comprises a light-conducting rod having an elongated planar face, said planar face being illuminable by said light-emitting source to provide an illuminated region around said light-conducting rod.

9. The invention of claim 8 wherein said illuminated region has a width of less than 0.040 inches.

10. The invention of claim 2 wherein said switching means includes a second override switch for shutting off the power to the light-emitting source.

11. The invention of claim 2 further comprising a means for adjustably mounting said illuminated gunsight on a barrel of a firearm.

12. The invention of claim 11 wherein said mounting means further comprises removable brackets to grippingly engage the barrel of a firearm.

13. The invention of claim 2 wherein said sighting device includes means to vary the intensity of the light emanating from said light-emitting source.

14. The invention of claim 1 wherein said sighting device further comprises elongated fluorescent regions located on said housing to provide sight lines for aiming a weapon in natural or artificial light.

15. An illuminated sighting device for attachment to a firearm to enable a user to aim and shoot a firearm with either conventional sights or the illuminated sighting device comprising:

a housing for attachment to a firearm;

an elongated U-shaped sighting channel located in said housing, said channel having a first end and a second end;

a light-emitting source for supplying light to produce a first illuminated sight, said light-emitting source located in one end of said sighting channel; and a second illuminated sight, said second illuminated sight located in said second end of said sighting channel, said second illuminated sight and said first illuminated sight operable to enable a user to aim a weapon attached to said housing.

16. The invention of claim 15 wherein said elongated U-shaped channel includes a strip of fluorescent material to provide a rear sight.

17. The invention of claim 15 wherein said elongated U-shaped channel includes a light-transmitting member having a region for emanating light through said elongated region.

18. The invention of claim 17 wherein said elongated U-shaped channel includes an elongated strip of fluorescent material located parallel the light emanating from said elongated region.

* * * * *